US005687536A

United States Patent [19]

Lin

[11] Patent Number: 5,687,536

[45] Date of Patent: Nov. 18, 1997

[54] FRAME STRUCTURE FOR THE FRAMEWORK OF A REINFORCED CONCRETE FLOOR

[76] Inventor: Hsia-Sen Lin, No. 27, Ing Min 1 Lane, Tao Ing Road, Bar Der City, TaoYuan, Taiwan

[21] Appl. No.: 607,393

[22] Filed: Feb. 27, 1996

[51] Int. Cl.[6] ..... E04C 5/16

[52] U.S. Cl. ..... 52/719; 52/685; 52/660

[58] Field of Search ..... 52/650.2, 651.09, 52/652.1, 656.8, 659, 660, 664, 676, 649.1, 719, 677, 680, 681, 682, 684, 685

[56] References Cited

U.S. PATENT DOCUMENTS 5,181,363 1/1993 Leach et al. ..... 52/719 X

FOREIGN PATENT DOCUMENTS 125056 10/1931 Austria .

2126670 12/1972 Germany ..... 52/660

2111552 7/1983 United Kingdom ..... 52/660

15287 8/1993 WIPO ..... 52/660

*Primary Examiner*—Carl D. Friedman

*Assistant Examiner*—Creighton Smith

*Attorney, Agent, or Firm*—Bacon & Thomas

[57] ABSTRACT

A frame structure including at least one base rod; a plurality of struts respectively fastened to the at least one base rod; a plurality of shear members respectively fastened to the at least one base rod; and a plurality of horizontal connecting hooks, each having a first end fixedly connected to the at least one base rod and a second end terminating in a hooked portion. By connecting the connecting hooks of one frame structure to the connecting hooks of another, a plurality of frame structures are connected together to form a framework for a reinforced concrete floor.

9 Claims, 5 Drawing Sheets

FRAME STRUCTURE FOR THE FRAMEWORK OF A REINFORCED CONCRETE FLOOR

BACKGROUND OF THE INVENTION

The present invention relates to reinforced concrete floors, and relates more particularly to a frame structure for forming the framework of a reinforced concrete floor.

When constructing a reinforced concrete floor, a plurality of reinforcing bars are set in the formwork with a proper space left within the formwork around the reinforced bars, and then the formwork is grouted up with concrete. Because the positioning of the reinforcing bars in the formwork is not an easy job and the accuracy of the positioning of the reinforcing bars is determined subject to the experience of the workers, it is difficult to achieve the desired quality when constructing a reinforced concrete floor.

SUMMARY OF THE INVENTION

The present invention overcomes the above problem. It is one object of the present invention to provide a frame structure which is specifically designed for constructing the framework of a reinforced concrete floor. It is another object of the present invention to provide a frame structure which can be quickly set up. It is still another object of the present invention to provide a frame structure which can be easily and accurately installed.

According to one aspect of the present invention, the frame structure comprises at least one base rod; a plurality of struts respectively fastened to the at least one base rod; a plurality of shear members respectively fastened to the at least one base rod; and a plurality of horizontal connecting hooks, each having a first end fixedly connected to the at least one base rod and a second end terminating in a hooked portion. By connecting the connecting hooks of one frame structure to the connecting hooks of another, a plurality of frame structures are connected together to form a framework for a reinforced concrete floor. According to another aspect of the present invention, the base rods, the struts, the shear members, and the connecting hooks are respectively made from metal wire or wire rods, and all members can be connected by welding or hooking. According to another aspect of the present invention, the at least one base rod includes a plurality of rods connected into a matrix such that a plurality of matrices can be connected together to form a framework by connecting the horizontal connecting hooks of one frame structure to another. According to still another aspect of the present invention, the struts and the shear members are connected to the connecting points between the transverse rods and the longitudinal rods. According to still another aspect of the present invention, a plurality of downward hooks are respectively connected to the at least one base rod by hooking. According to still another aspect of the present invention, the struts have a V-shaped profile, the shear members have an O-shaped profile, and each of the shear members is respectively and integrally made with one strut. According to still another aspect of the present invention, the struts include at least two struts arranged in a line connected to a bottom rod.

BRIEF DESCRIPTION OF THE DRAWINGS

The present invention will now be described by way of example with reference to the annexed drawings in which.

DETAILED DESCRIPTION OF THE PREFERRED EMBODIMENT

Figure 1:
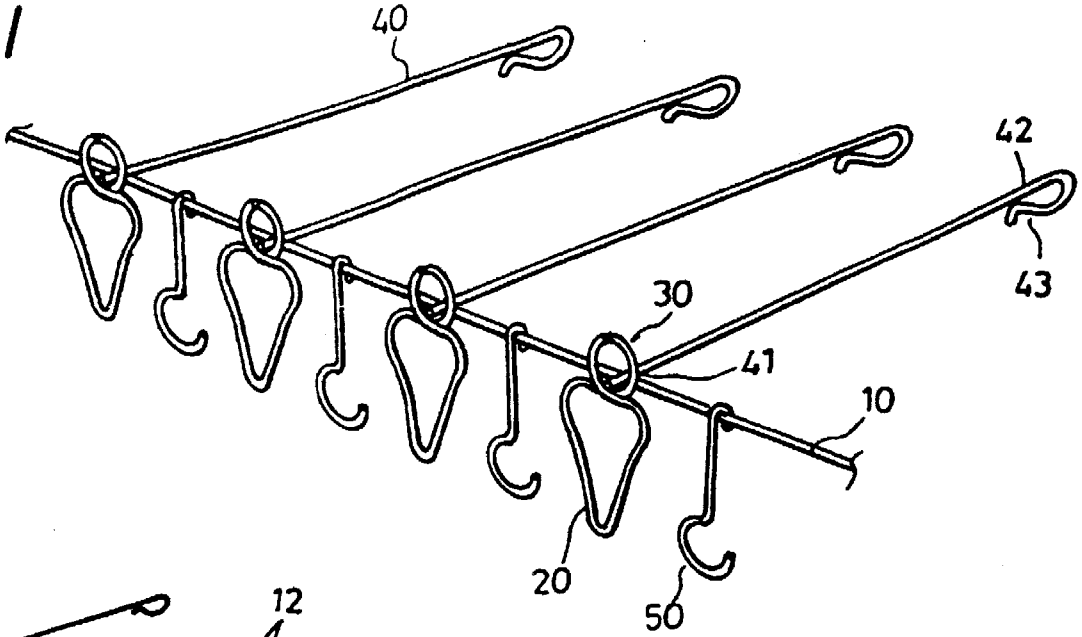
FIG. 1 shows a frame structure according to the present invention.

Referring to FIG. 1, a frame structure for the framework of a reinforced concrete floor in accordance with the present invention is generally comprised of a base rod 10, a plurality of struts 20, a plurality of shear rings 30, a plurality of horizontal connecting hooks 40, and a plurality of downward hooks 50. The the struts 20 and the shear rings 30 are respectively fastened to the base rod 10. The horizontal connecting hooks 40 are respectively and perpendicularly connected to the base rod 10, each having a first end 41 connected to the base rod 10 and a second end 42 terminating in a hooked portion 43. The downward hooks 50 are respectively and perpendicularly connected to the base rod 10 at the bottom.

Figure 2:
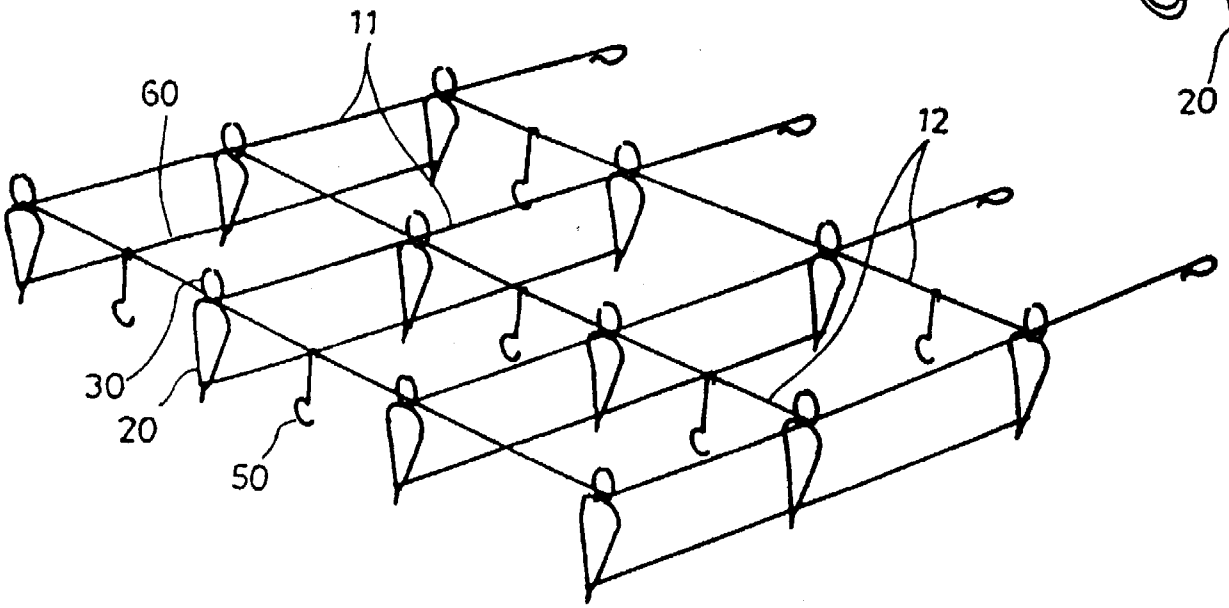
FIG. 2 shows a matrix type frame structure according to the present invention.

FIG. 2 shows a "matrix type" frame structure according to the present invention. This frame structure comprises a plurality of a plurality of base rods consisting of a plurality of transverse rods 12 and a plurality of longitudinal rods 11 connected into a meshed structure by welding, a plurality of struts 20, a plurality of shear rings 30, a plurality of struts 50, and a plurality of bottom rods 60. The struts 20 and the shear rings 30 are respectively welded to the connecting points between the transverse rods 12 and the longitudinal rods 11. The downward hooks 50 are respectively and perpendicularly fastened to the transverse rods 12 at the bottom. The bottom rods 60 are respectively connected to the struts 20 at the bottom in parallel to the longitudinal rods 11.

Figure 3:
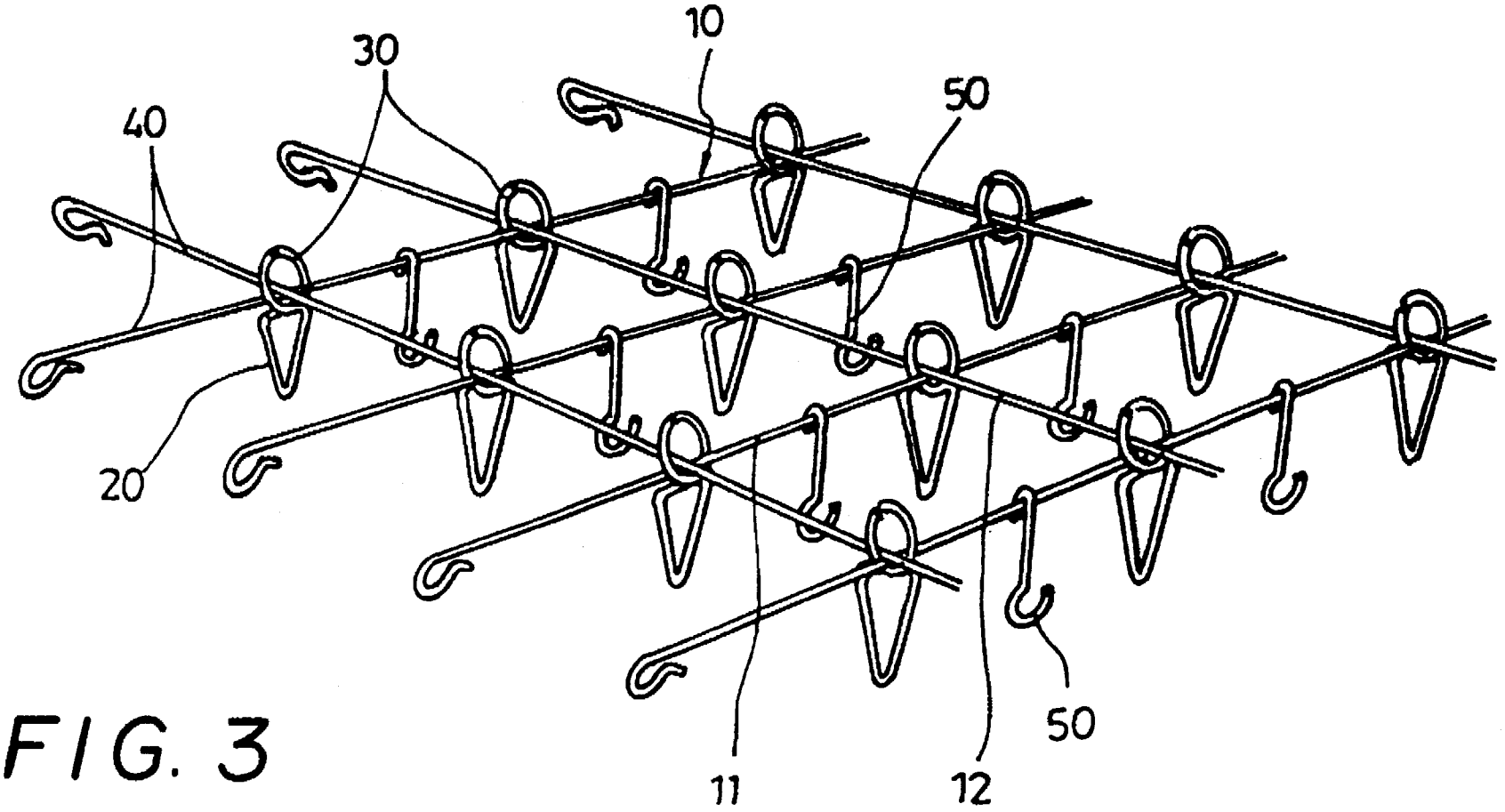
FIG. 3 shows an alternate form of the matrix type frame structure according to the present invention.
Figure 4:
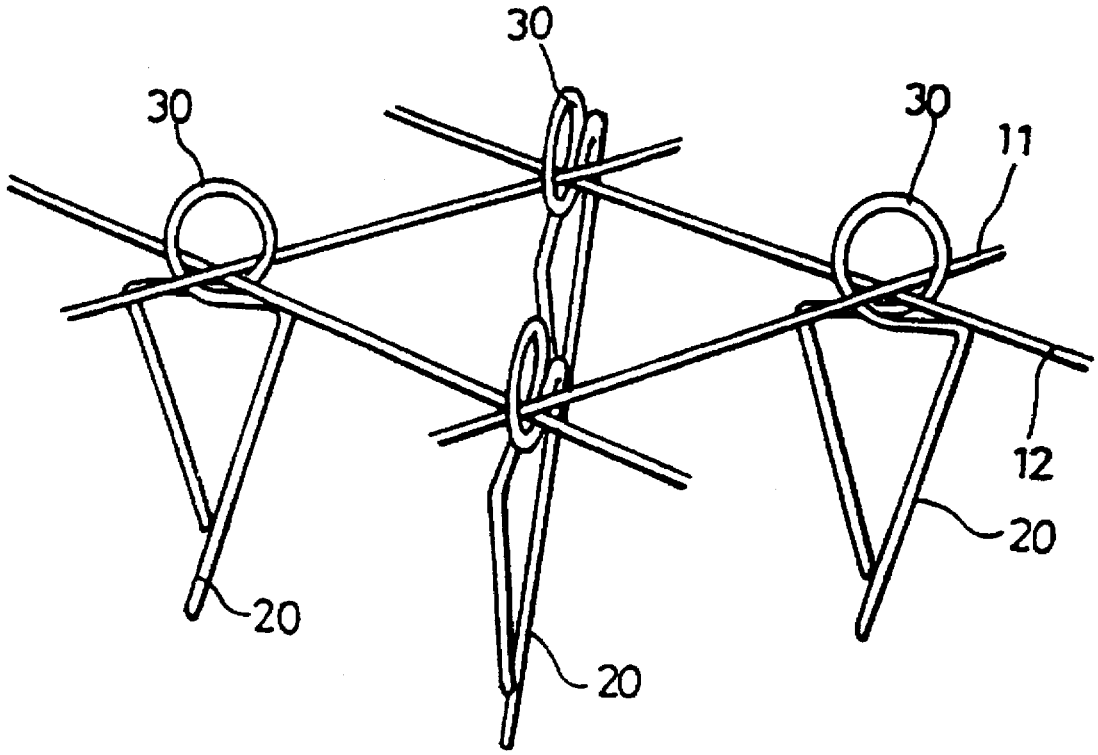
FIG. 4 shows the shear members and the struts connected to the connecting points between the transverse rods and the longitudinal rods, and each shear member integrally made with the respective strut from an iron wire.

FIGS. 3 and 4 show another "matrix type" frame structure according to the present invention, in which the transverse rods 12 and the longitudinal rods 11 are connected into a meshed structure by the shear rings 30. Each of the shear rings 30 is integrally made with the respective strut 20 from an iron wire by bending.

Figure 5:
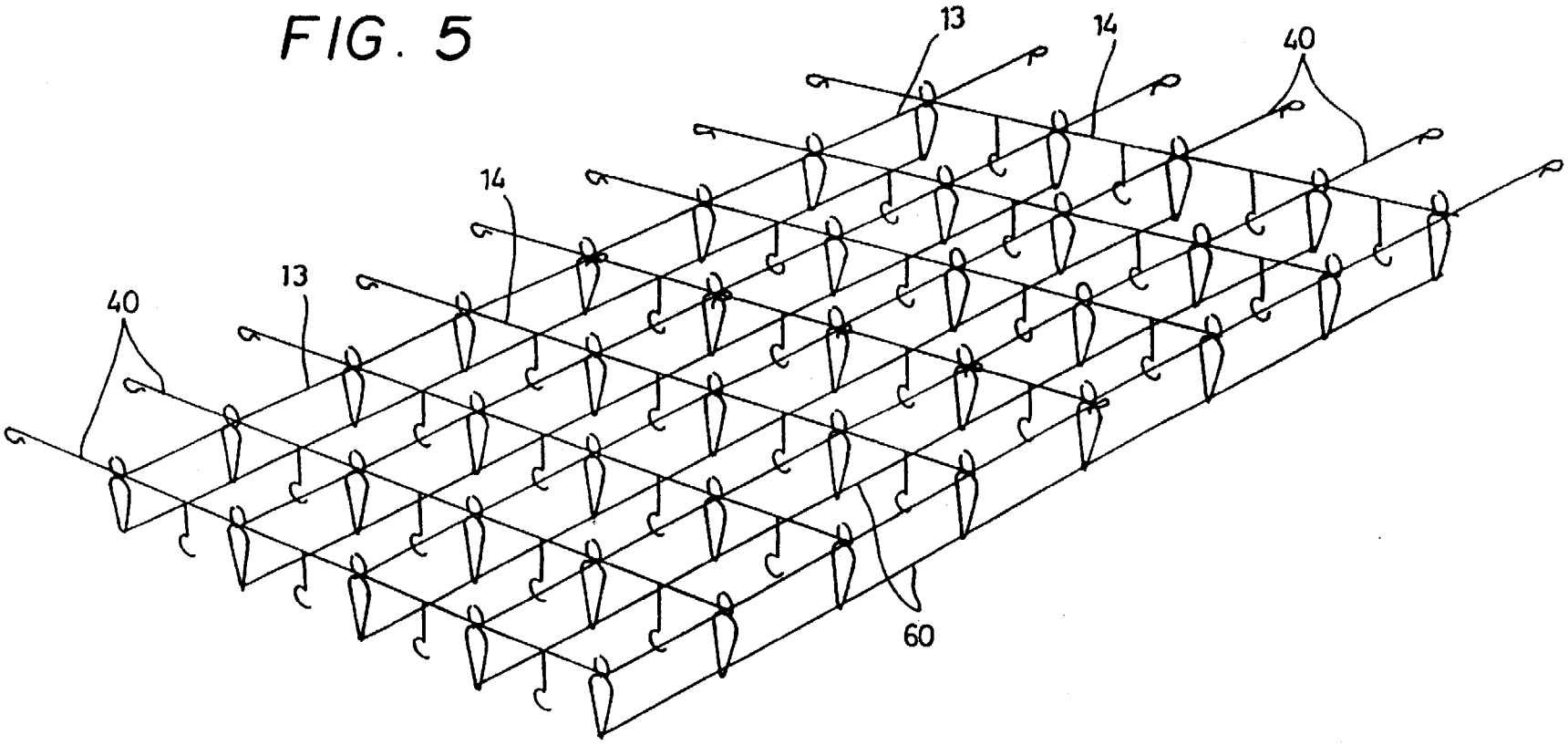
FIG. 5 shows two matrix type frame structures connected together according to the present invention.

Referring to FIG. 5, a plurality of horizontal connecting hooks 40 are respectively disposed at one longitudinal side 13 and one transverse side 14 for permitting a plurality of matrix type frame structures to be connected to one another side by side.

Figure 6:
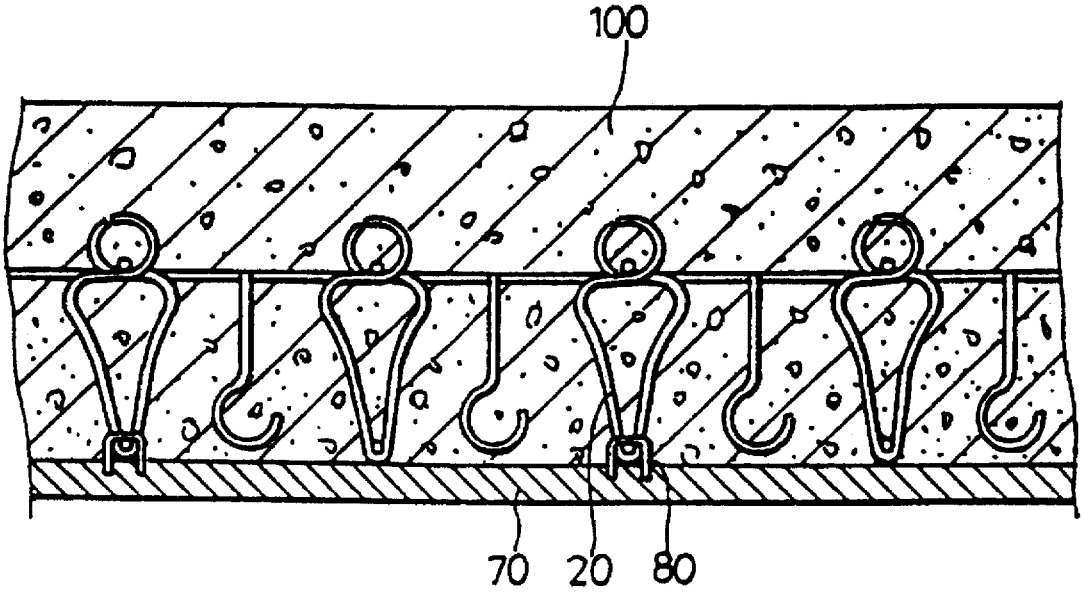
FIG. 6 is an installed view of the present invention, showing the struts fastened to the bottom shutter and the frame structure embedded in concrete.

Referring to FIG. 6, during the construction, the frame structure is constructed above the bottom shutter 70 of the formwork, and the struts 20 are fixedly secured to the bottom shutter 70 by nails 80. When the frame structure is set up, concrete 100 is then grouted into the formwork.

Figure 7:
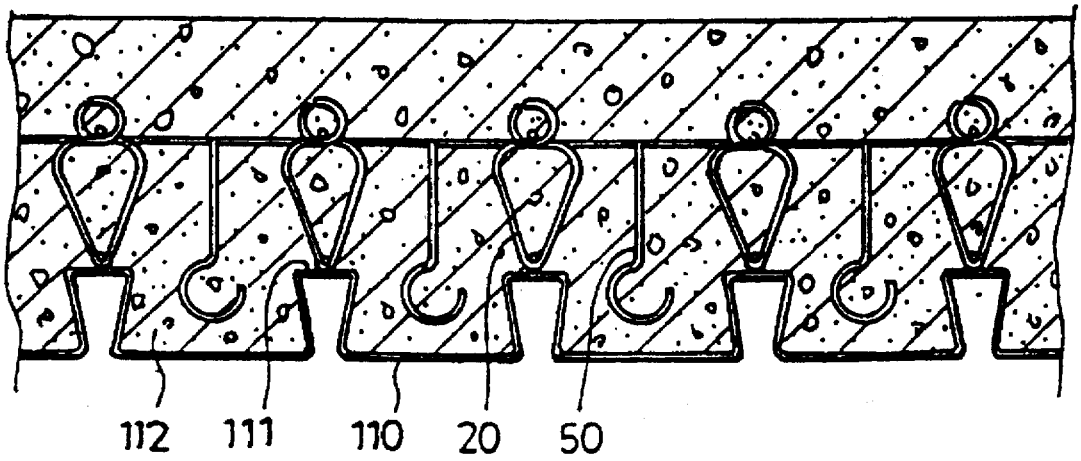
FIG. 7 is another installed view of the present invention, showing the frame structure used with a corrugated steel plate and embedded in concrete.

Referring to FIG. 7, the frame structure of the present invention may be constructed with a corrugated steel plate 110. When the frame structure is used with a corrugated steel plate 110, the downward hooks 50 must be made relatively longer than the struts 20 such that the struts 20 can be supported on the raised portions 111 of the corrugated steel plate 110, the downward hooks 50 can be inserted into the recessed portions 112 of the corrugated steel plate 110 to reinforce the cement in the recessed portions 112.

It will be understood that the drawings are designed for purposes of illustration only, and are not intended as a definition of the limits and scope of the disclosed invention.

What the invention claimed is:

1. A frame structure comprising:

at least one base rod;

a plurality of struts respectively fastened to said at least one base rod;

a plurality of shear members respectively fastened to said at least one base rod;

a plurality of horizontal connecting hooks, each having a first end fixedly connected to said at least one base rod and a second end terminating in a hooked portion for connecting other frame structures to form a framework for a reinforced concrete floor; and a plurality of downward hooks respectively connected to said at least one base rod.

2. The frame structure of claim 1 wherein said at least one base rod includes a plurality of rods connected into a matrix.

3. The frame structure of claim 1 wherein each of said shear members is respectively and integrally made with one strut.

4. The frame structure of claim 1 wherein each of said downward hooks has one end detachably hooked on said at least one base rod.

5. The frame structure of claim 2 wherein said at least one base rod includes a plurality of transverse rods and a plurality of longitudinal rods connected into a meshed structure by welding to define a plurality of connecting points between said transverse and longitudinal rods.

6. The frame structure of claim 5 wherein said shear members are respectively fastened to the connecting points between said transverse rods and said longitudinal rods.

7. A frame structure comprising:

a plurality of base rods connected into a matrix having two opposite transverse sides and two opposite longitudinal sides;

a plurality of struts respectively fastened to the base rods;

a plurality of shear members respectively fastened to the base rods; and a plurality of horizontal connecting hooks disposed at one transverse side and one longitudinal side of the matrix, each hook having a first end fixedly connected to a base rod and a second end terminating in a hooked portion for connecting other frame structures to form a framework for a reinforced concrete floor.

8. A frame structure comprising:

at least one base rod;

a plurality of struts respectively fastened to said at least one base rod, the struts each having a V-shaped profile;

a plurality of shear members respectively fastened to said at least one base rod, the shear members each having an O-shaped profile; and a plurality of horizontal connecting hooks, each connecting hook having a first end fixedly connected to said at least one base rod and a second end terminating in a hooked portion for connecting other frame structures to form a framework for a reinforced concrete floor.

9. A frame structure comprising:

at least one base rod and at least one bottom rod;

a plurality of struts respectively fastened to said at least one base rod and at least two struts arranged in a line and connected to the at least one bottom rod;

a plurality of shear members respectively fastened to said at least one base rod; and a plurality of horizontal connecting hooks, each connecting hook having a first end fixedly connected to said at least one base rod and a second end terminating in a hooked portion for connecting other frame structures to form a framework for a reinforced concrete floor.

* * * * *